US007669564B2

(12) United States Patent
Tochiki et al.

(10) Patent No.: US 7,669,564 B2
(45) Date of Patent: Mar. 2, 2010

(54) VARIABLE VALVE LIFT INTERNAL COMBUSTION ENGINE

(75) Inventors: Hirokazu Tochiki, Wako (JP); Mitsuru Sugimoto, Wako (JP); Kiminori Komura, Wako (JP); Fumihisa Takemoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 153 days.

(21) Appl. No.: 11/902,406

(22) Filed: Sep. 21, 2007

(65) Prior Publication Data

US 2008/0072854 A1 Mar. 27, 2008

(30) Foreign Application Priority Data

Sep. 25, 2006 (JP) ..... 2006-258275
Sep. 25, 2006 (JP) ..... 2006-258331
Sep. 27, 2006 (JP) ..... 2006-262222

(51) Int. Cl.
*F01L 1/34* (2006.01)

(52) U.S. Cl. ..... 123/90.16; 123/90.39; 74/569

(58) Field of Classification Search ..... 123/90.16, 123/90.39, 90.44, 90.27, 90.31; 74/559, 74/567, 569

See application file for complete search history.

(56) References Cited

U.S. PATENT DOCUMENTS

2005/0211197 A1 9/2005 Fujii et al.

FOREIGN PATENT DOCUMENTS

| | | | |
|---|---|---|---|
| DE | 199 60 742 | A1 | 6/2001 |
| JP | 06-307219 | A | 11/1994 |
| JP | 2004-521234 | A | 7/2004 |
| JP | 2004-521235 | A | 7/2004 |
| JP | 2004-239249 | A | 8/2004 |
| JP | 2005-248874 | A | 9/2005 |
| JP | 2005-344702 | A | 12/2005 |

*Primary Examiner*—Ching Chang
(74) *Attorney, Agent, or Firm*—Arent Fox LLP

(57) ABSTRACT

Provided is a variable valve lift internal combustion engine including a control shaft pivotally supported by a cylinder head via a pivot arm pivotally supported by the cylinder head so as to able to move angularly around a rotational center line extending in parallel with an axial line of the control shaft, a power transmitting member supported by the control shaft, an actuator for causing an angular movement of the control shaft around the rotational center line via the power transmitting member and a control arm having a base end pivotally supported by the control shaft and a free end interposed between a cam lobe of an engine camshaft and a part of a rocker arm. The lift of the engine valve can be varied by angularly moving the control shaft around the rotational center line and moving the base end of the control arm.

14 Claims, 12 Drawing Sheets

VARIABLE VALVE LIFT INTERNAL COMBUSTION ENGINE

TECHNICAL FIELD

The present invention relates to a variable valve lift internal combustion engine, and in particular to a technology for simplifying the structure of the mechanism for varying the valve lift and improving the durability of the mechanism.

BACKGROUND OF THE INVENTION

In the field of four-stroke gasoline engines, there have been proposals to use valve lift varying mechanisms with the aims of improving engine output and fuel economy and reducing undesired emission from the engine. It has been practiced to prepare low speed cams and high speed cams on a same camshaft and select the cams according to the operating condition of the engine. It has also been practiced to interpose a control arm or control link between a valve cam and a rocker arm and varying the geometry of the control arm or control link for varying the valve lift in a continuous manner (See WO2002/092972 and Japanese patent laid open publication No. 2005-248874). Presently, there is a growing demand for a system that can vary the cam phase and valve lift individually.

The inventors of the present application have developed a variable valve lift system for a multi-cylinder engine which uses a control shaft pivotally supported by a cylinder head so as to be able to move angularly around a rotational center line extending in parallel with the camshaft of the engine. The control shaft pivotally supports a control link having a free end interposed between the cam lobe and the rocker arm. This provides a favorable solution to the task of providing a compact and reliable variable valve lift system.

The inventors have also noted that a pivot arm that pivotally supports the control shaft is subjected to a significant load, and it is important to ensure a high mechanical rigidity in pivotally supporting the control arm so that the tilting or twisting of the control shaft may be avoided. It was also noted that lubrication of various parts is highly important for ensuring a reliability of the system.

BRIEF SUMMARY OF THE INVENTION

Based on such a recognition by the inventors, a primary object of the present invention is to provide a variable valve lift internal combustion engine which is compact in design.

A second object of the present invention is to provide a variable valve lift internal combustion engine which is durable in use.

A third object of the present invention is to provide a variable valve lift internal combustion engine which is provided with a highly rigid structure so that the valve lift of the engine valve can be controlled in a highly precise manner.

According to the present invention, such objects can be accomplished by providing a variable valve lift internal combustion engine, comprising: an engine valve; a camshaft mounted on a cylinder head of the engine and including a cam lobe; a rocker arm pivotally supported by the cylinder head and including a first part that engages a valve stem of the engine valve; a control shaft pivotally supported by the cylinder head via a pivot arm pivotally supported by the cylinder head so as to able to move angularly around a rotational center line extending in parallel with an axial line of the control shaft; a power transmitting member supported by the control shaft; an actuator for causing an angular movement of the control shaft around the rotational center line via the power transmitting member; and a control arm having a base end pivotally supported by the control shaft and a free end interposed between the cam lobe and a second part of the rocker arm; a lift of the engine valve being varied by angularly moving the control shaft around the rotational center line and moving the base end of the control arm.

The control arm is thus supported by the control shaft which is in turn supported by the cylinder head in such a manner that the control arm can be supported in an adjustable manner while ensuring a high mechanical rigidity of the overall structure. Therefore, the lift of the engine valve can be precisely controlled. In particular, if the pivot arm and the power transmitting member are formed by an integral link member including a pivot arm portion pivotally supported by the cylinder head, a support portion pivotally supporting the control shaft and a power transmitting portion extending from the support portion and engaging an output end of the actuator, a highly rigid and compact structure can be achieved.

According to a preferred embodiment of the present invention, the power transmitting portion of the integral link member comprises a driven gear portion that meshes with a drive gear of the actuator. The overall height of the system can be minimized if the drive gear comprises a sector gear. If an intermediate gear is interposed between the drive gear and the driven gear portion, a high speed reduction ratio can be achieved so that the output requirement of the actuator can be minimized, and this allows the use of a highly compact actuator. To ensure a favorable lubrication of the drive mechanism and thereby ensure a high durability of the system, the power transmitting portion of the integral link member may comprise a driven gear portion that meshes with a drive gear of the actuator, and an oil hole is provided in the cam holder for supplying lubricating oil to a part where the driven gear portion meshes with the drive gear.

It is highly advantageous to make use of components which are already available in cylinder heads of normal engines. More specifically, the base end of the pivot arm may be pivotally supported by a cam holder. In particular, if the base end of the pivot arm is pivotally supported by a pivot pin which is passed partly into a journal bore or a journal bearing of the cam holder, the cam holder including an oil hole for supplying lubricating oil to the journal bearing, a highly robust and favorably lubricated structure can be realized. It is particularly desirable if the cam holder includes a pair of bifurcated support walls, and the pivot pin is passed across the support walls, the base end of the pivot arm being formed with a journal bore or a journal bearing through which an intermediate part of the pivot pin passes. For favorable lubrication of the pivot pin, the pivot pin may be formed with an axial oil groove for conducting lubricating oil to the journal bearing formed in the base end of the pivot arm.

The control shaft is allowed to move angularly between a minimum valve lift position and a maximum valve lift position, and it is necessary to avoid any overshooting of the control shaft beyond such limit positions for a proper operation of the system. If the cam holder is provided with stopper portions for restricting a range of the angular movement of the control shaft, highly robust and durable stopper portions can be obtained, and this contributes to a proper and reliable operation of the variable valve lift mechanism.

To minimize the distortion of the control shaft such as the twisting and tilting of the control shaft, it is desirable to use the cam holder supporting the base end of the pivot arm centrally along a length of the control shaft.

To further reinforce the rigidity of the control shaft when the engine includes a plurality of cam holders arranged along the rotational center line, the upper ends of the cam holders may be connected by a base plate with one another. The base plate may be conveniently used as a part of a head cover. To ensure the air-tightness of the space accommodating the valve actuating mechanism, the head cover may cover a valve actuating mechanism provided on a cylinder head of the engine jointly with the base plate, the head cover including an edge that abuts a surface of the base plate via a seal member. According to a particularly favorable embodiment of the present invention, the head cover is provided with an annular configuration including a central window, and a peripheral edge of the head cover surrounding the central window abuts a surface of the base plate via a seal member.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
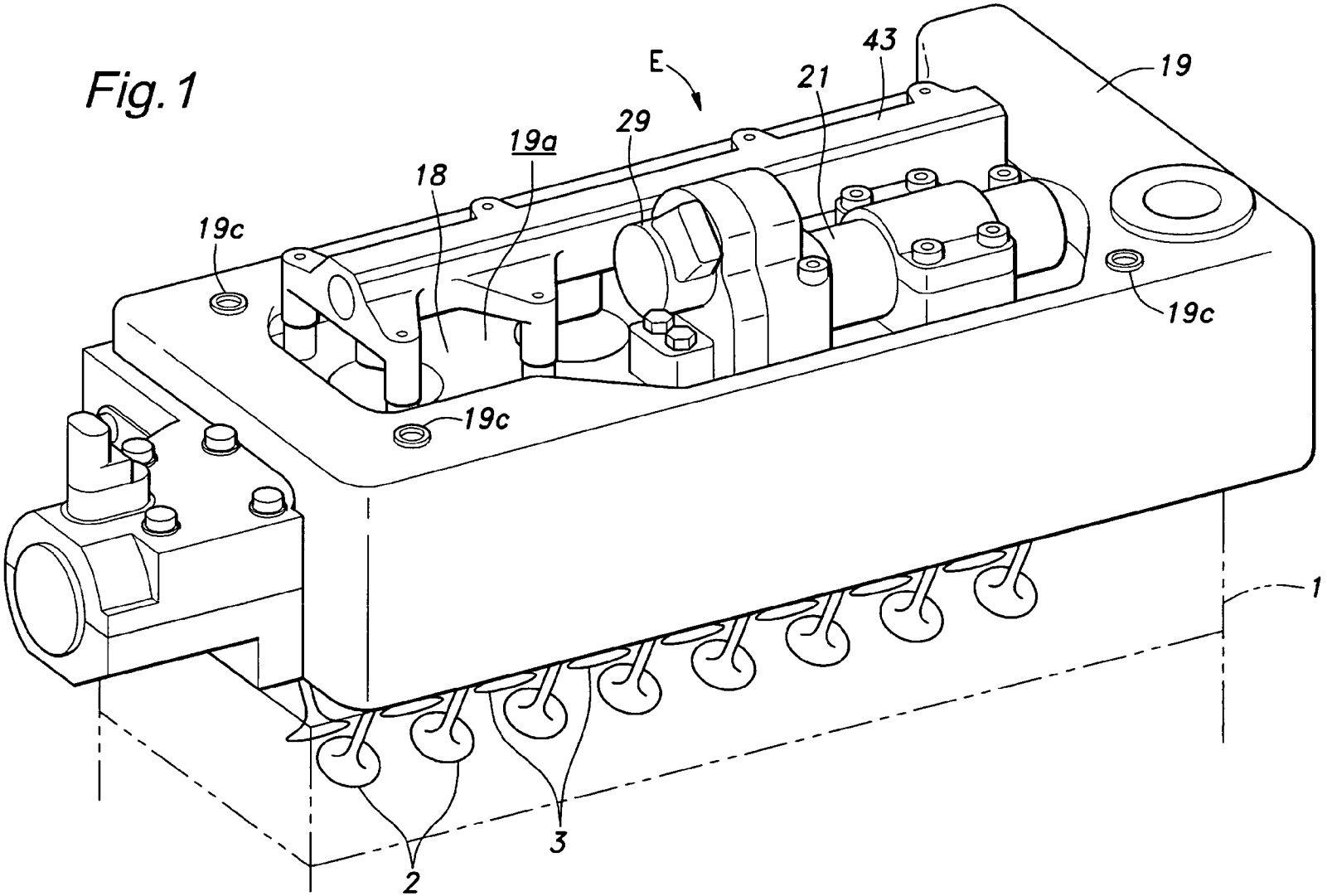
FIG. 1 is a fragmentary perspective view of an upper part of an engine incorporated with a variable valve lift mechanism embodying the present invention.

The engine E (variable valve lift internal combustion engine) shown in FIG. 1 consists of a four-stroke, in-line four-cylinder gasoline engine for automobiles, and a cylinder head 1 of this engine comprises a pair of exhaust valves 2 and a pair of intake valves 3 for each cylinder C. These valves 2 and 3 are actuated by DOHC four-valve valve actuating system driven by an exhaust camshaft 4 and an intake camshaft 5 (which is omitted from illustration in FIG. 2). Between each exhaust valve 2 and the exhaust camshaft 4 is interposed an exhaust rocker arm 6. Between each intake valve 3 and the intake camshaft 5 is interposed an intake rocker arm 7. The exhaust valves 2 and intake valves 3 are normally urged in the closing directions by corresponding valve springs 9 and 10. It should be noted that the application of the present invention is not limited to the engine of the illustrated embodiment, and is applicable to all kinds of reciprocating internal combustion engines including, not exclusively, Otto cycle engines, diesel engines as well as single cylinder engines and multiple cylinder engines which may be either in-line or V-type.

Figure 2:
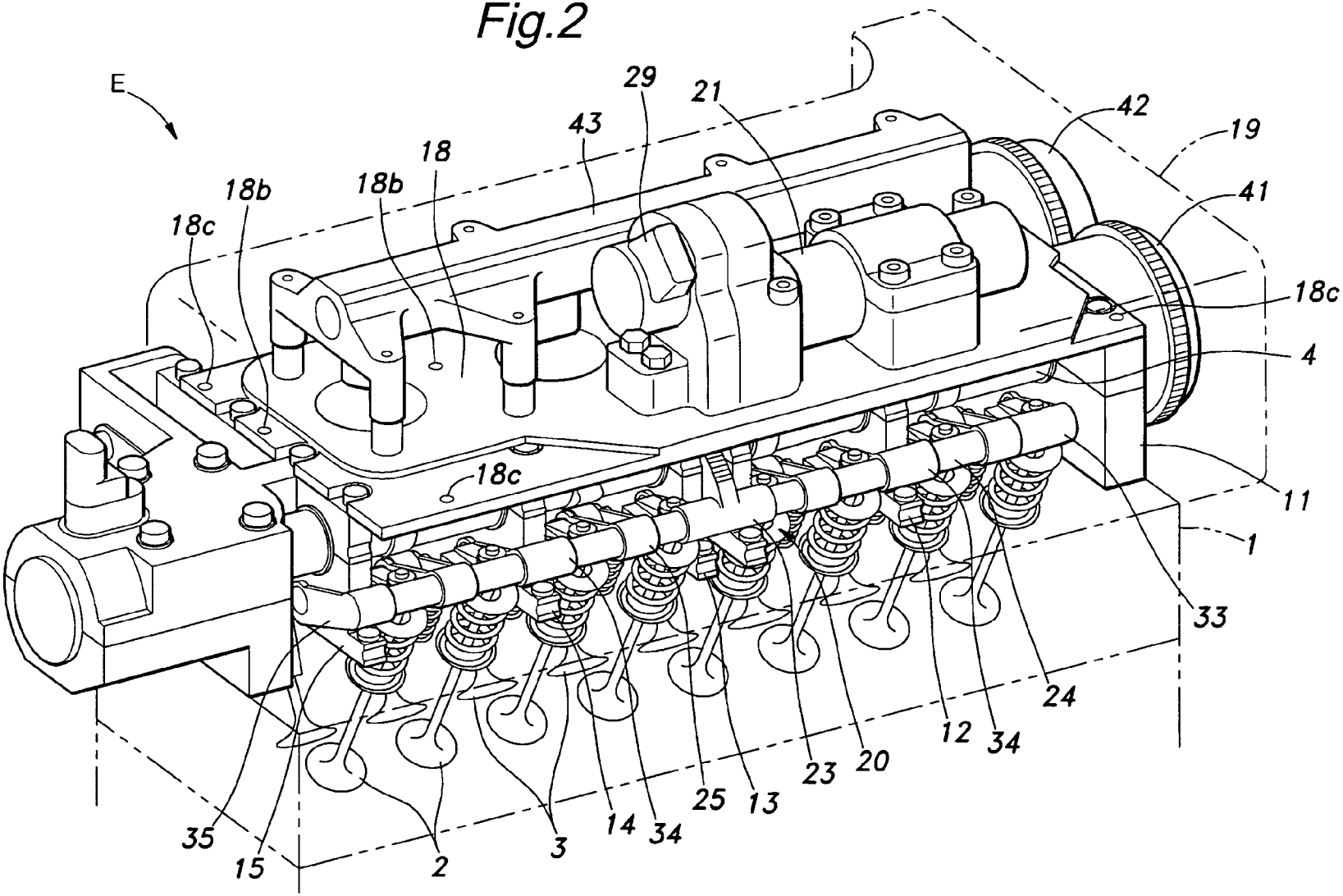
FIG. 2 is a view similar to FIG. 1 showing the upper part of the engine with the engine cover removed.
Figure 3:
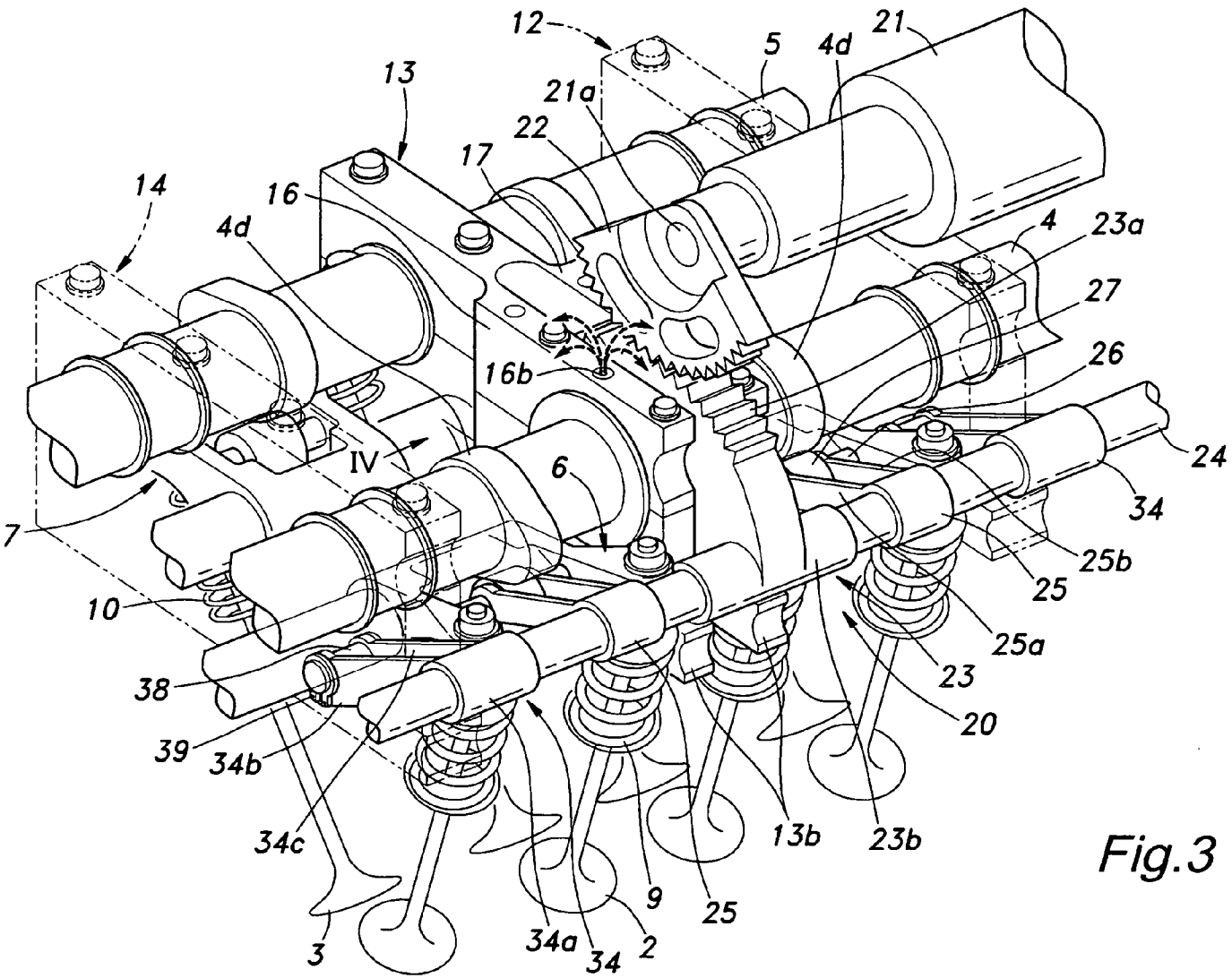
FIG. 3 is a fragmentary perspective view of the variable valve lift mechanism.

Five cam holders 11 to 15 are secured to the upper surface of the cylinder head 1 in a mutually spaced relationship and along the lengthwise direction of the cylinder head 1 to rotatably support the two camshafts 4 and 5 and rocker shafts for the rocket arms 6 and 7. The cam holder on the right end as seen in FIG. 2 is referred to as the front cam holder 11, the one in the middle as the center cam holder 13, the one the left end as the rear cam holder 15, and the remaining ones as the middle cam holders 12 and 14. As shown in FIG. 3, the center cam holder 13 is bifurcated into a pair of support walls 16 and 17 at the exhaust end thereof, and the axially central part of the exhaust camshaft 4 is supported by these support walls 16 and 17. To the upper surfaces of the cam holders 11 to 15 are attached a base plate 18 that covers the valve actuating mechanism in cooperation with a head cover 19.

The engine E of the illustrated embodiment is equipped with a pair of variable valve timing control (VTC) mechanisms 41 and 42 that variably and continually control the angular phases of the two camshafts 4 and 5, respectively, and a variable valve lift control (VLC) mechanism 20 for variable and continually controlling the lift of the exhaust valve 2 as a part of a variable valve control system.

VLC Mechanism

Figure 4:
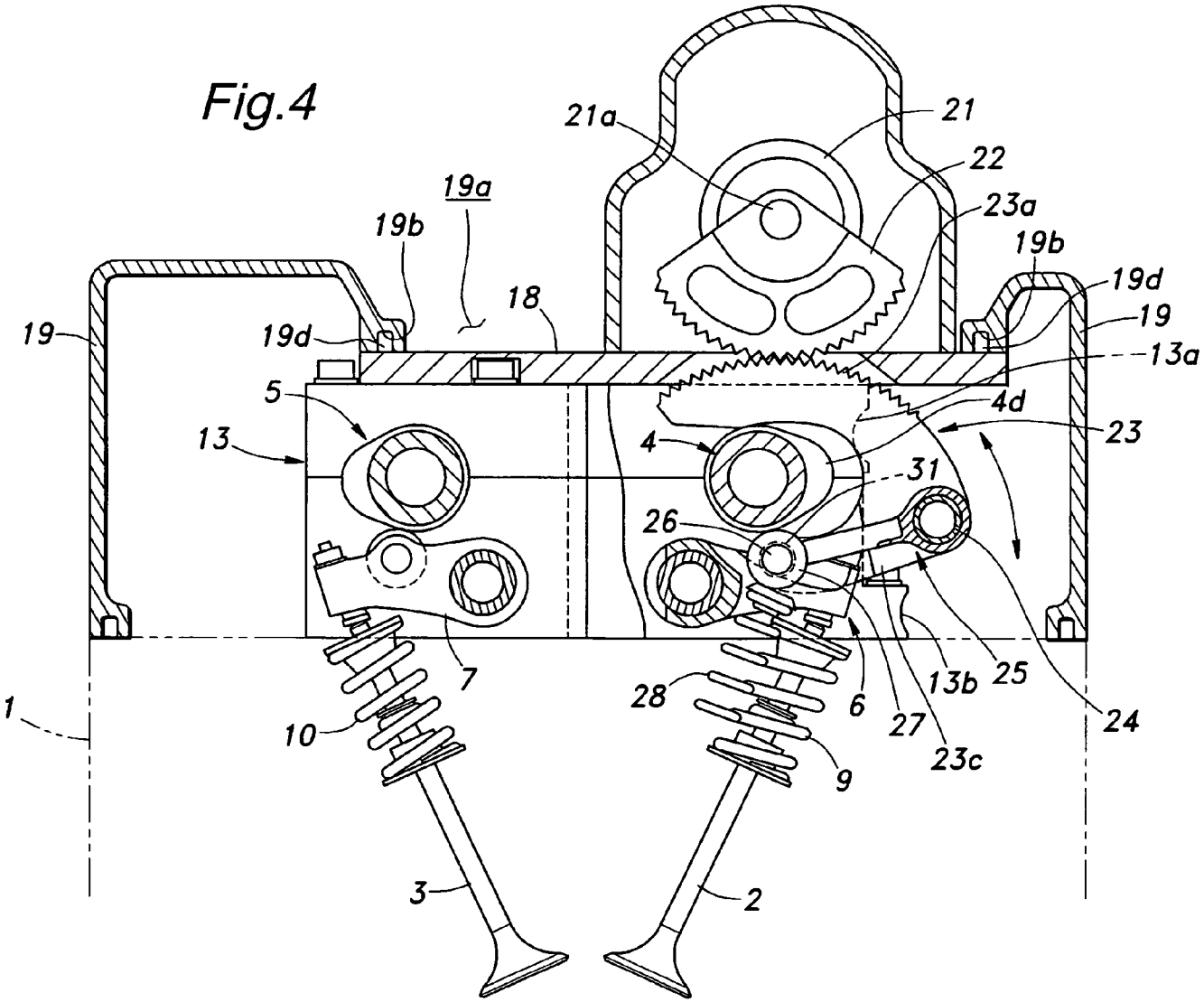
FIG. 4 is a cross sectional view as seen in the direction indicated by arrow IV in FIG. 3.

As shown in FIGS. 3 and 4, the VLC mechanism 20 comprises an electric motor (actuator) 21 mounted on the base plate 18 (not shown in FIG. 3) in parallel with the two camshafts 4 and 5, a sector drive gear 22 attached to an output shaft 21*a* of the electric motor 21, a gear link (driven gear) 23 consisting of an integral member including a driven gear portion 23*a*, a pivot arm portion 23*c* and a shaft holder portion 23*b*, a control shaft 24 rotatably passed through the shaft holder portion 23*b* of the gear link 23, a control arm (roller link) 25 provided for each cylinder and having a base end through which the control shaft 24 is rotatably passed, a roller 27 rotatably supported by the free end of each control arm 25 via a roller shaft 26, and a spring unit 28 which normally urges each roller 27 toward the exhaust camshaft 4 or in particular the corresponding cam lobe thereof. Numeral 29 in FIGS. 1 and 2 denote a rotary encoder for detecting the angular position of the drive gear 22, and an engine ECU not shown in the drawings determines the position of the control shaft 24 according to an output signal from the rotary encoder 29 to feedback control the electric current supplied to the electric motor 21.

Figure 5:
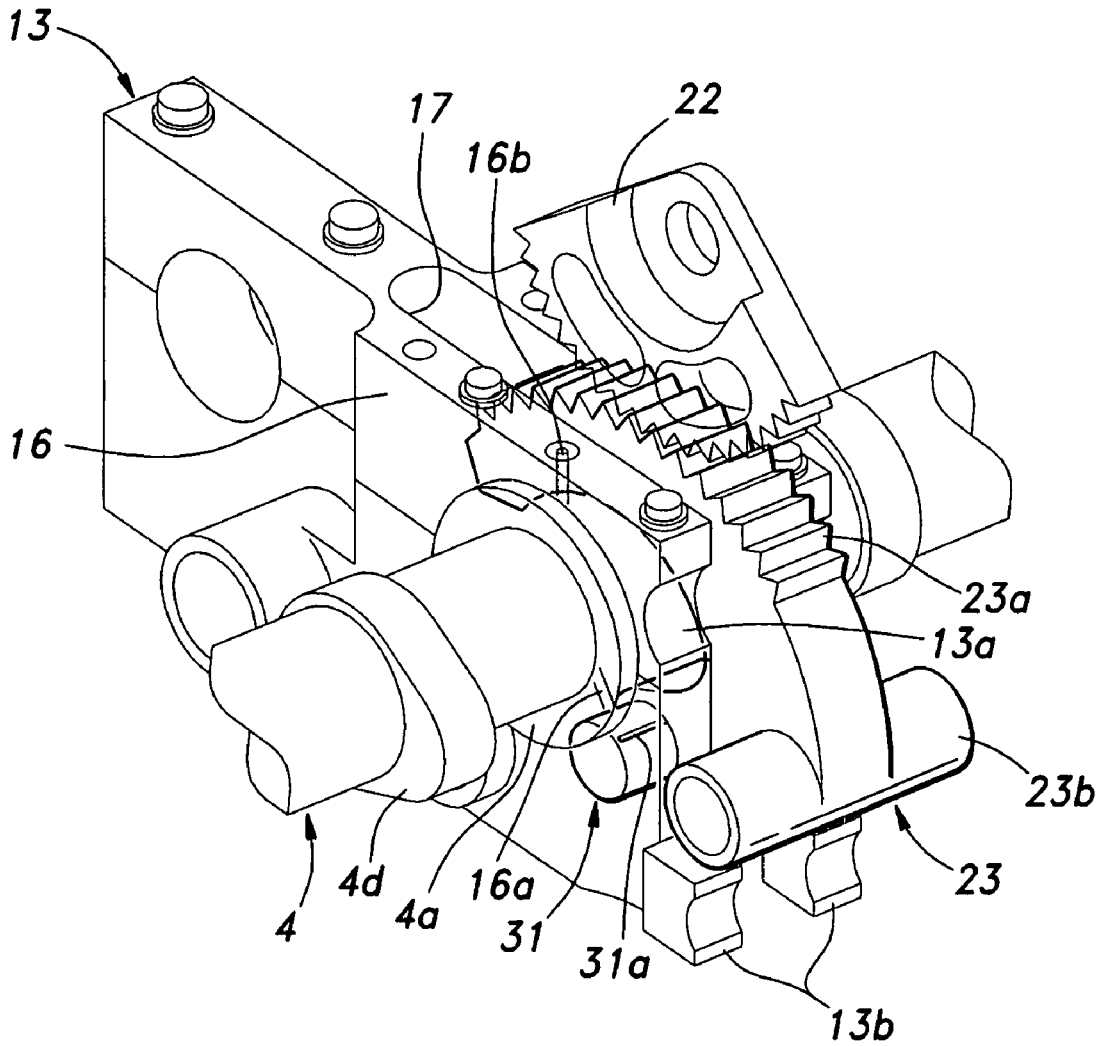
FIG. 5 is a perspective view showing the gear link and center cam holder.
Figure 6:
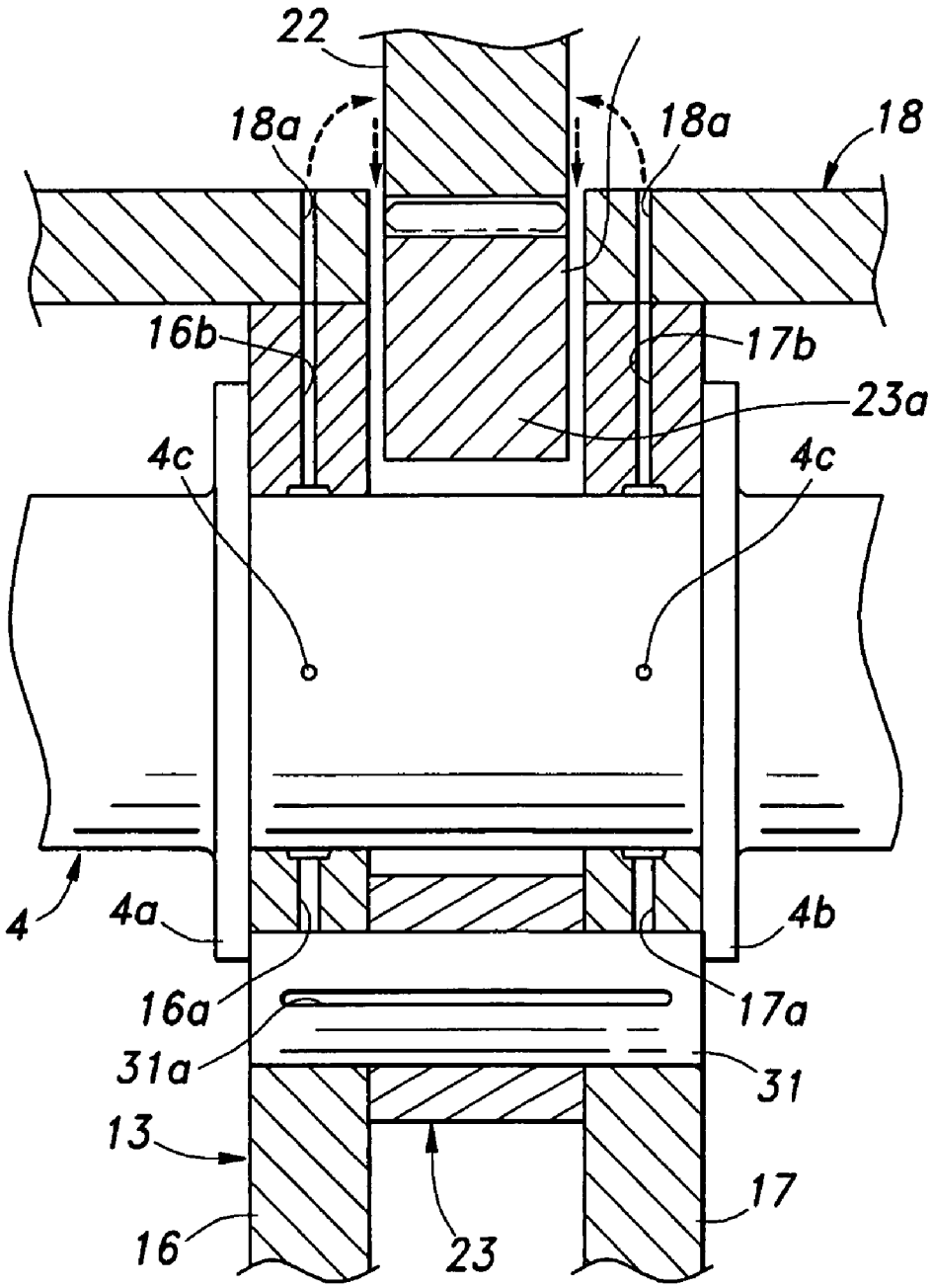
FIG. 6 is a sectional view showing the gear link and center cam holder.

FIG. 5 is a fragmentary perspective view showing the relationship between the center cam holder 13 and gear link 23, and FIG. 6 is a sectional view of the center cam holder 13 and gear link 23 at a part where these two components are connected to each other. As shown in FIGS. 4 to 6, the gear link 23 is rotatably supported at the pivot arm portion 23*c* thereof by the support walls 16 and 17 of the center cam holder 13 via a support pin 31, and is angularly actuated by the drive gear 22 that meshes with the driven gear portion 23*a*. The two axial ends surfaces of the support pin 31 are engaged by corresponding thrust flanges 4*a* and 4*b* formed in the exhaust camshaft 4.

As shown in FIGS. 5 and 6, an oil groove 31*a* is formed longitudinally on the outer circumferential surface of the support pin 31, and oil holes 16*a* and 17*a* are formed in the corresponding support walls 16 and 17 of the center cam holder 13 so that the engine oil fed from an oil hole 4*c* formed in the exhaust camshaft 4 is supplied to the outer circumferential surface of the support pin 31 via the oil holes 16*a* and 17*a* and the oil groove 31*a*. The center cam holder 13 and base plate 18 are also formed with oil holes 16*b*, 17*b* and 18*a* for spouting the engine oil fed from an oil hole 4*c* formed in the exhaust camshaft 4 upward from the upper surface of the base plate 18 to lubricate the part where the drive gear 22 and the driven gear portion 23*a* among other places.

Figure 8:
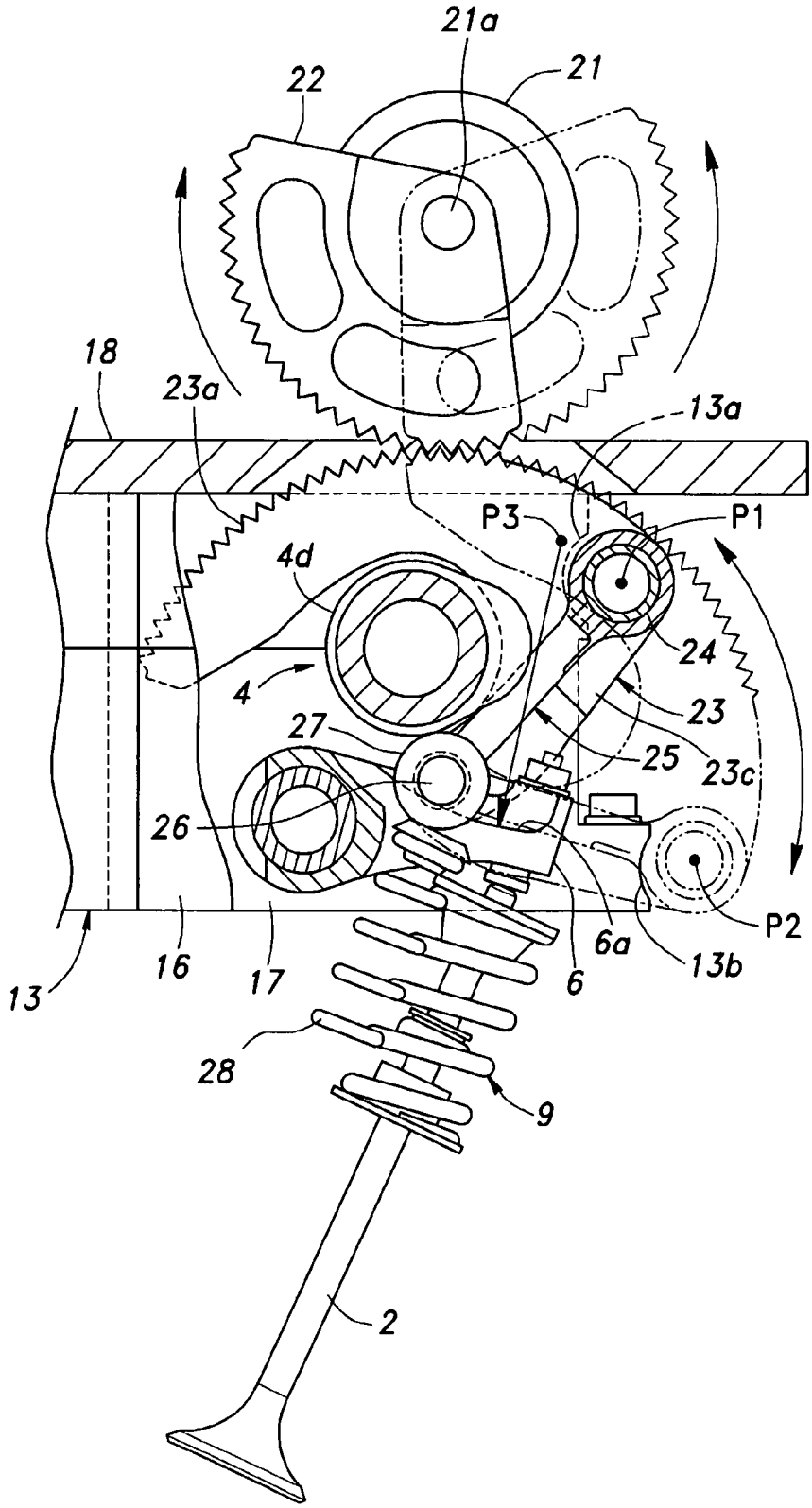
FIG. 8 is a side view of the variable valve lift mechanism showing the range of movements of various parts for adjusting the valve lift.

FIG. 8 shows the range of the variable actuation stroke of the VLC mechanism. The gear link 23 can turn continuously from a position indicated by the solid lines in FIG. 8 (minimum lift position) and a position indicated by broken lines in FIG. 8 (maximum lift position), and this angular movement of the gear link 23 causes a rotation of the control shaft 24 (and hence the shaft holder portion 23*b*) around the support pin 31. The vertical end surfaces of the support walls 16 and 17 facing the exhaust side are each provided with an upper stopper portion 13*a* for limiting an upward angular movement of the shaft holder portion 23*b* (and hence the gear link 23) and a lower stopper portion 13*b* for liming a downward angular movement of the shaft holder portion 23*b* (and hence the gear link 23). More specifically, in the illustrated embodiment, the range of the angular movement of the gear link 23 is defined not by any separate stopper members but by stopper portions 13*a* and 13*b* formed in appropriate parts of the support walls 16 and 17. Because the gear link 23 moves only between the minimum lift position and maximum lift position, the contact between the stopper portions 13*a* and 13*b* and the shaft holder portion 23*b* does not cause any wear to these components. The engagement between the stopper portions 13*a* and 13*b* and the shaft holder portion 23*b* positively prevent any overshooting of the gear link 23 beyond the minimum lift position or maximum lift position.

The control shaft 24 is rotatably supported not only by the center cam holder 13 via the gear link 23 but also by the remaining cam holders 11, 12, 14 and 15 via a front link holder 33, a pair of middle link holders 34 and a rear link holder 35. The front link holder 33 is pivotally supported on an end surface of the front cam holder 11 and the rear link holder 35 is pivotally supported on an end surface of the rear cam holder 15 while each of the middle link holders 34 is pivotally supported by the corresponding middle cam holder 12, 14 via a pair of arms 34*b* and 34*c* as illustrated in FIG. 3. More specifically, the ends of the arms 34*b* and 34*c* remote from the control shaft 24 are connected to either end of a pin 38, via a C clip 39, which is passed through the corresponding middle cam holder 12, 14. Therefore, the arms 34*b* and 34*c* are supported by the corresponding middle cam holder 12, 14 in a symmetric manner. The pin 38 is lubricated by the engine oil which is supplied from the middle cam holders 12 and 14 via oil holes (not shown in the drawings) communicating with the exhaust camshaft 4. Each of the front cam holder 11, the middle cam holders 12 and 14 and the rear cam holder 15 is provided with an upper stopper portion and a lower stopper portion for limiting the angular movement of the corresponding link holder.

As shown in FIG. 8, each the control arm 25 pivots around a minimum lift point P1 when the gear link 23 is at the minimum lift position, and around a maximum lift point P2 when the gear link 23 is at the maximum lift position. The roller 27 is interposed between a pair of link arms 25*a* and 25*b* forming the control arm 25 and is rotatably supported by the roller shaft 26 around an axial line extending across the link arms 25*a* and 25*b*, and engages the cam lobe 4*b* of the exhaust camshaft 4. The roller shaft 26 extends laterally outward from either link arms 25*a* and 25*b*, and engages arcuate surfaces 6*a* formed on the corresponding exhaust rocker arms 6. Each arcuate surface 6*a* has an arc center P3 located upwardly and inwardly with respect to the minimum lift point P1.

Base Plate

Referring to FIG. 2, the planar base plate 18 is attached to the upper surfaces of the cam holders 11 to 15 by passing threaded bolts through mounting holes 18*b* formed in the base plate 18 and threading into the threaded holes of the corresponding cam holders 11 to 15. The base plate 18 securely joins the upper parts of the cam holders 11 to 15 with one another so as to reinforce the cam holders 11 to 15 against forces that may tend to tilt the cam holders. The base plate 18 additionally serves as a base for supporting the electric motor 21, and a fuel pipe housing 43 accommodating fuel delivery pipes therein. As will be discussed hereinafter, the base plate 18 serves also as a part of the head cover for the cylinder head 1.

The base plate 18 includes a planar region for supporting the electric motor 21, and threaded holes 18*c* for securing the head cover 19 are provided in a peripheral part of the base plate 18. As shown in FIG. 1, the head cover 19 is formed with mounting holes 19*c*, and is attached to the upper part of the cylinder head 1 by passing threaded bolts through these mounting holes 19*c* and threading them into the threaded holes 18*c*. As shown in FIG. 6 (although omitted in FIGS. 3 and 5), oil holes 18*a* and 18*b* are formed in parts of the base plate 18 adjacent to the center cam holder 18 for upwardly spouting lubricating oil supplied thereto via oil holes 16*b* and 17*b* formed in the support walls 16 and 17. This oil lubricates the meshing part between the sector drive gear 22 and the driven gear portion 23*a* of the gear link 23, and other parts of the gear link 23.

Head Cover

Figure 7:
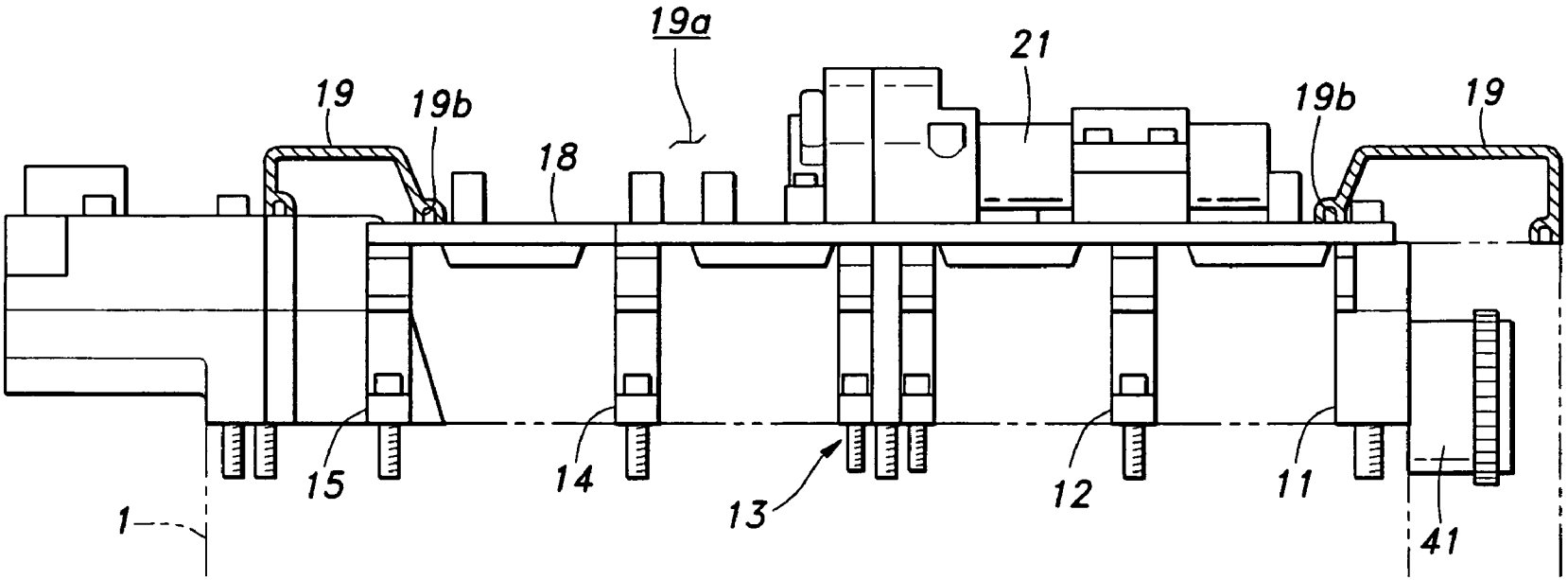
FIG. 7 is a front view of various components mounted on the cylinder head partly in section.

FIG. 4 shows a cross section of the head cover 19 and FIG. 7 shows a longitudinal section of the head cover 19. As shown in these drawings, the head cover 19 is provided with a central window 19*a* which overlaps with a central part of the base plate 18, and the peripheral edge of the head cover 19 surrounding the central window 19*a* is formed as a vertical flange whose free end abuts the upper surface of the outer peripheral part of the base plate 18 via a seal member 19*d* that is received in a groove 19*b* extending over the entire length of the vertical flange. The seal member 19*d* partly projects from the groove 19 under an unstressed condition so that the seal member 19*d* provides a favorable sealing effect in cooperation with the opposing surface by undergoing a resilient deformation. The outer peripheral edge of the head cover 19 is also formed as a vertical flange that abuts the outer peripheral part of the top surface of the cylinder head 1 via a similar seal member 19*d* that is received in a groove 19*b* extending over the entire length of the vertical flange. In this manner, the valve actuating mechanism is completely enclosed jointly by the head cover 19 and the base plate 18 in an air tight manner. The head cover 19 in the illustrated embodiment is generally annular in shape, but may also take other form such as C-shape, L-shape and so on as seen in plan view. Therefore, the central window in such a case would consist of a cutout instead of a fully surrounded opening.

Mode of Operation of the Illustrated Embodiment

Figure 9:
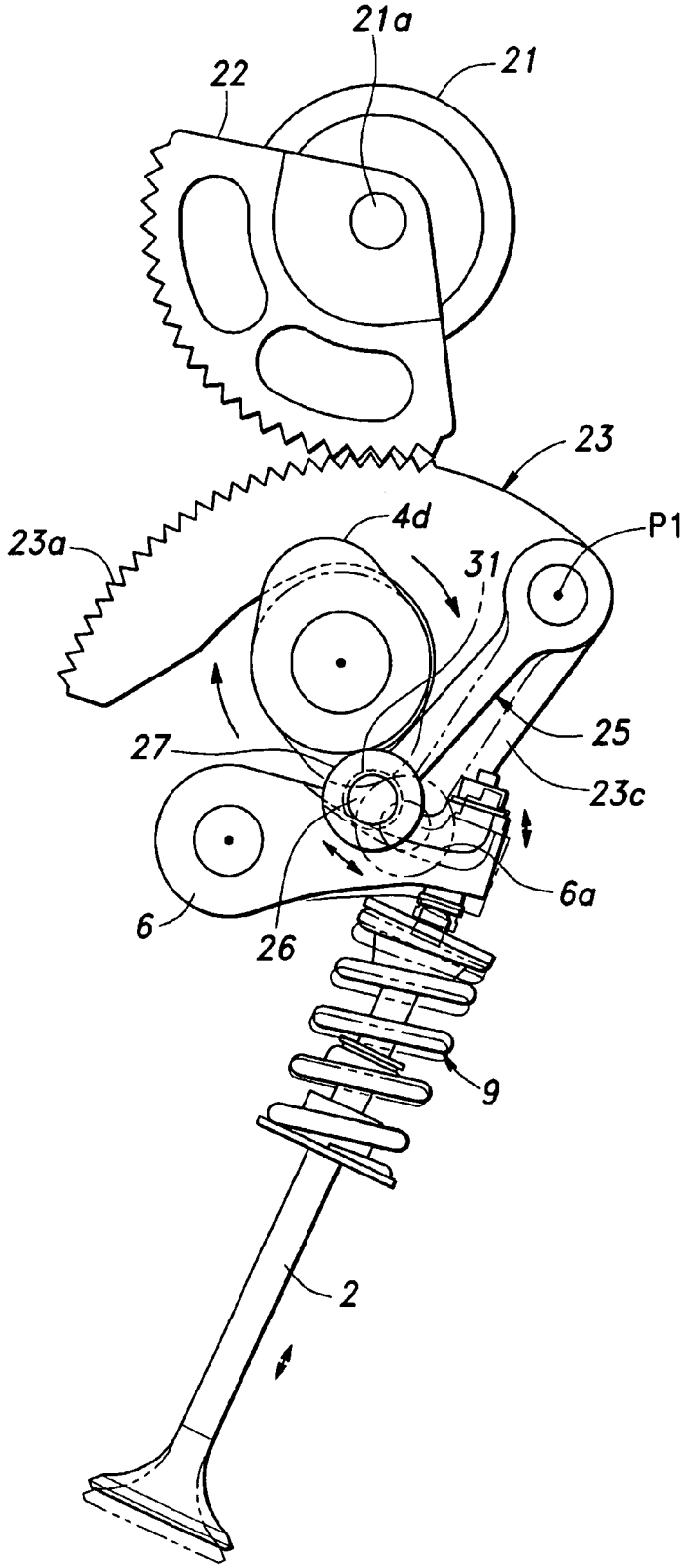
FIG. 9 is a side view of the variable valve lift mechanism at the maximum lift position.
Figure 10:
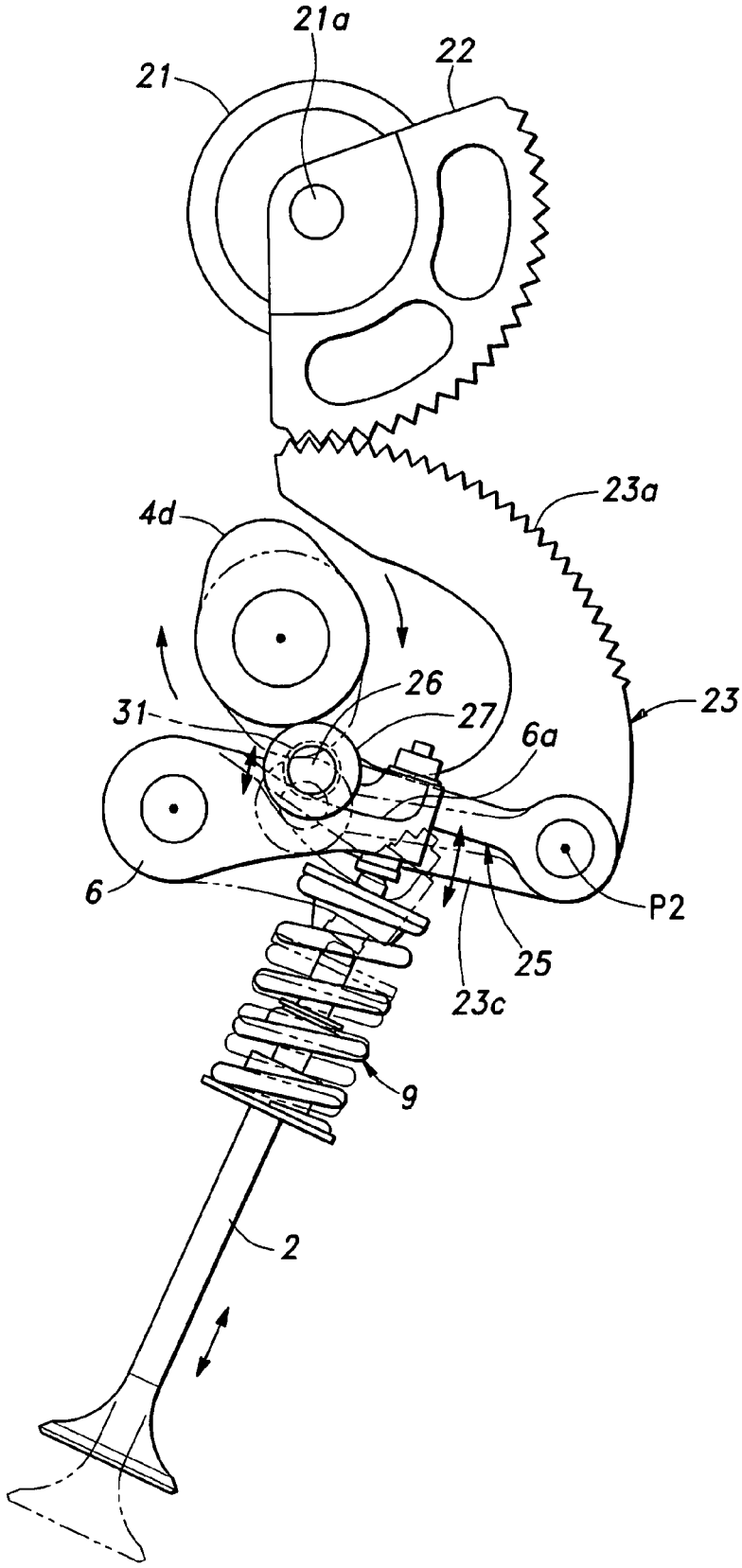
FIG. 10 is a side view of the variable valve lift mechanism at the minimum lift position.

The mode of operation of the illustrated embodiment is described in the following. FIG. 9 shows the VLC mechanism at the maximum lift position, and FIG. 10 shows the VLC mechanism at the minimum lift position. When the engine E is started, the engine ECU not shown in the drawings determines a target lift of the exhaust valves 2 according to various operating parameters such as the throttle pedal depression and cooling water temperature, and forwards a corresponding drive current to the electric motor 21 of the VLC mechanism 20. This causes the drive gear 22 attached to the output shaft 21*a* of the electric motor 21 to turn, and the gear link 23, having the driven gear portion 23*a* that meshes with the drive gear 22, to turn in either direction.

When the amount of internal EGR gas that can still combust is desired to be increased, the engine ECU turns the gear link 23 to the minimum lift position as shown in FIG. 9, and causes the control arm 25 to turn around the minimum lift point P1. As a result, when the roller 27 is pushed down by the cam lobe 4*d*, each roller shaft 26 is allowed to roll over the corresponding arcuate surface 6*a* as indicated by the arrow in FIG. 9, and the swing angle of the roller arm 6 (or the lift of the exhaust valve 2) is minimized. When a normal combustion condition is desired, the engine ECU turns the gear link 23 to the maximum lift position as illustrated in FIG. 10, and causes the control arm 25 to turn around the maximum lift point P2.

As a result, when the roller 27 is pushed down by the cam lobe 4*d*, the rolling of each roller shaft 26 over the corresponding arcuate surface 6*a* is minimized, and the swing angle of the roller arm 6 (or the lift of the exhaust valve 2) is maximized.

When the drive gear 22 drives the gear link 23, the meshing between the drive gear 23 and the driven gear portion 23*a* of the gear link 23 causes a significant reaction that tends to push the two parts away from each other. In particular, the gear link 23 is subjected to a significant downward force. In the illustrated embodiment, because the gear link 23 is supported by the support walls 16 and 17 on either side, and the gear link 23 is located in an axially central part of the exhaust camshaft 4, the gear link 23 and control shaft 24 are favorably supported against tilting and twisting deformations. The support pin 31 supporting the gear link 23 is lubricated by the engine oil not only at the journal bearings formed in the support walls 16 and 17 for supporting the support pin 31 but also at the journal bearing formed in the gear link 23 on account of the oil groove 31*a* formed in the support pin 31. Also, the engine oil which is upwardly spouted from the oil holes 18*a* of the base plate 18 favorably lubricates the meshing part between the drive gear 23 and the driven gear portion 23*a* and other parts above the base plate 18. Therefore, the various sliding parts of the gear link 23 are favorably lubricated, and are prevented from any undesired wear.

Because the exhaust camshaft 4 is supported by the bifurcated support walls 16 and 17 of the central cam holder 13 and is therefore supported over a greater length by the central cam holder 13 than any of the remaining cam holders 11, 12, 14 and 15. The resulting increase in the support rigidity of the exhaust camshaft 4 contributes in the reduction in the bending deformation of the exhaust camshaft 4 and the elimination in the variations in the valve lift from one cylinder to another.

In the illustrated embodiment, even when the gear link 23 is subjected to an excessive force that tends to push the gear link 23 beyond the minim lift position or maximum lift position, the shaft holder portion 23*b* of the gear link 23 is retained by the upper stopper portion 13*a* or the lower stopper portion 13*b* of the support walls 16 and 17. Similarly, each of the front cam holder 11, the middle cam holders 12 and 14 and the rear cam holder 15 is provided with an upper stopper portion and a lower stopper portion for limiting the angular movement of the corresponding link holder. Therefore, any excessive lifting of the valve can be avoided, and this prevents generation of noises and improper mode of engine operation.

The favorable lubrication of the meshing part between the drive gear 22 and the driven gear portion 23*a* minimizes the output requirement of the electric motor 21 for the actuation of the control shaft 24, and this allows a compact and light-weight design of the electric motor 21.

The cam holders 11 to 15 are subjected to various forces as they support not only the camshafts 4 and 5 and rocket arms 6 and 7, but also the gear link 23 and control shaft 24. However, because the base plate 18 connects the upper parts of the cam holders 11 to 15 to one another, the rigidity of the cam holders 11 to 15, in particular the rigidity against the tilting of the cam holders 11 to 15 can be increased. Therefore, the thickness (in the axial direction) of each cam holder can be reduced without any ill effect, and this contributes to a compact design of the engine E. Also, because a seal member 19*d* is interposed between the head cover 19 and base plate 18, the base plate 18 is able to fully function as a part of the head cover 19, and leaking of engine oil from the cam chamber can be avoided. Thereby, the head cover 19 may be provided with a central window 19*a*, and this also contributes to a light-weight design of the engine E.

Also, the drive gear 22 for transmitting the torque of the electric motor is formed as a sector gear having teeth only over an angular range necessary to mesh with the drive gear portion 23*a*, instead of a circular gear so that the weight of the drive gear 22 as well as the space requirement for the drive gear can be minimized. This again contributes to a compact and light-weight design of the engine E.

MODIFIED EMBODIMENT

Figure 11:
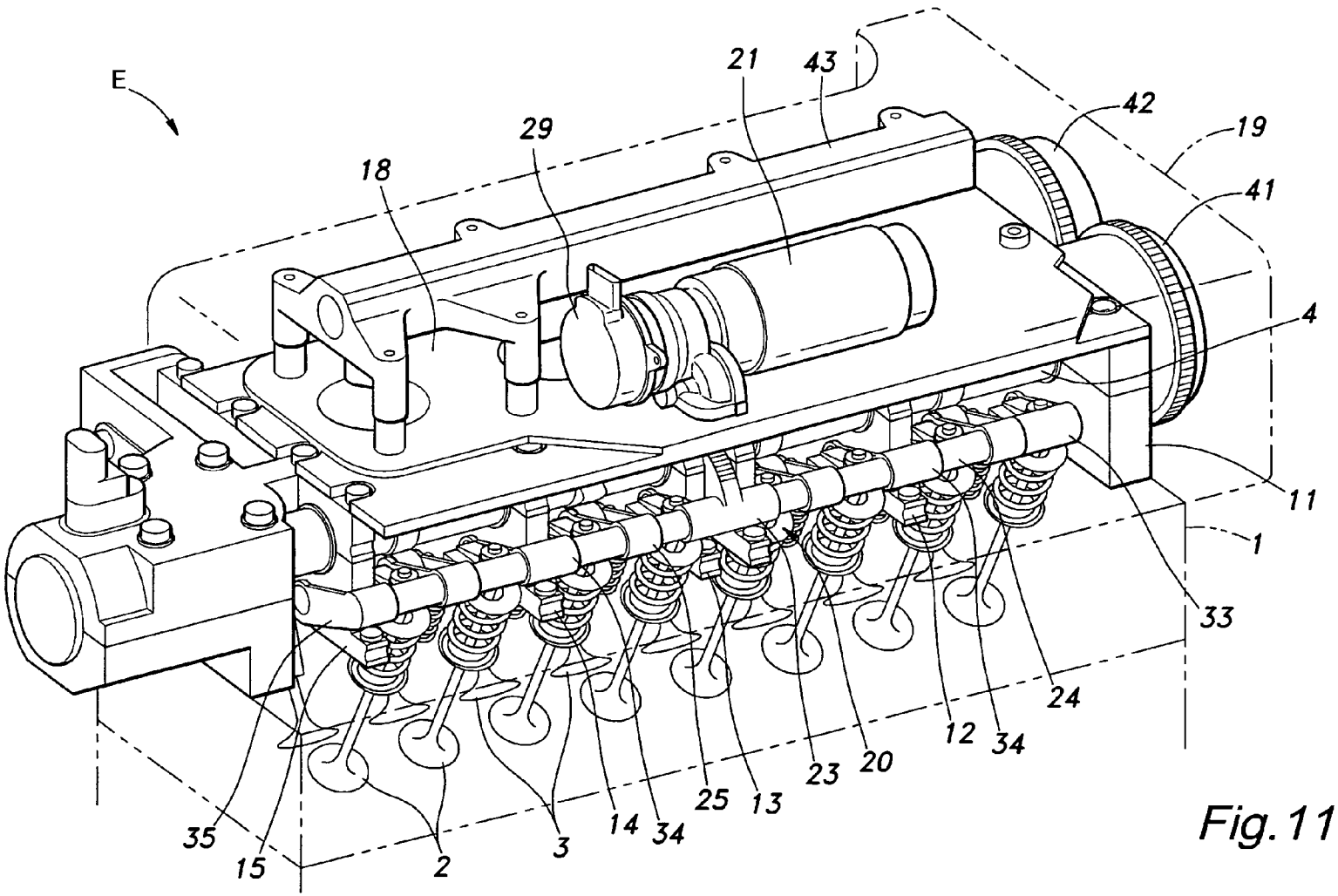
FIG. 11 is a view similar to FIG. 2 showing a second embodiment of the present invention.
Figure 12:
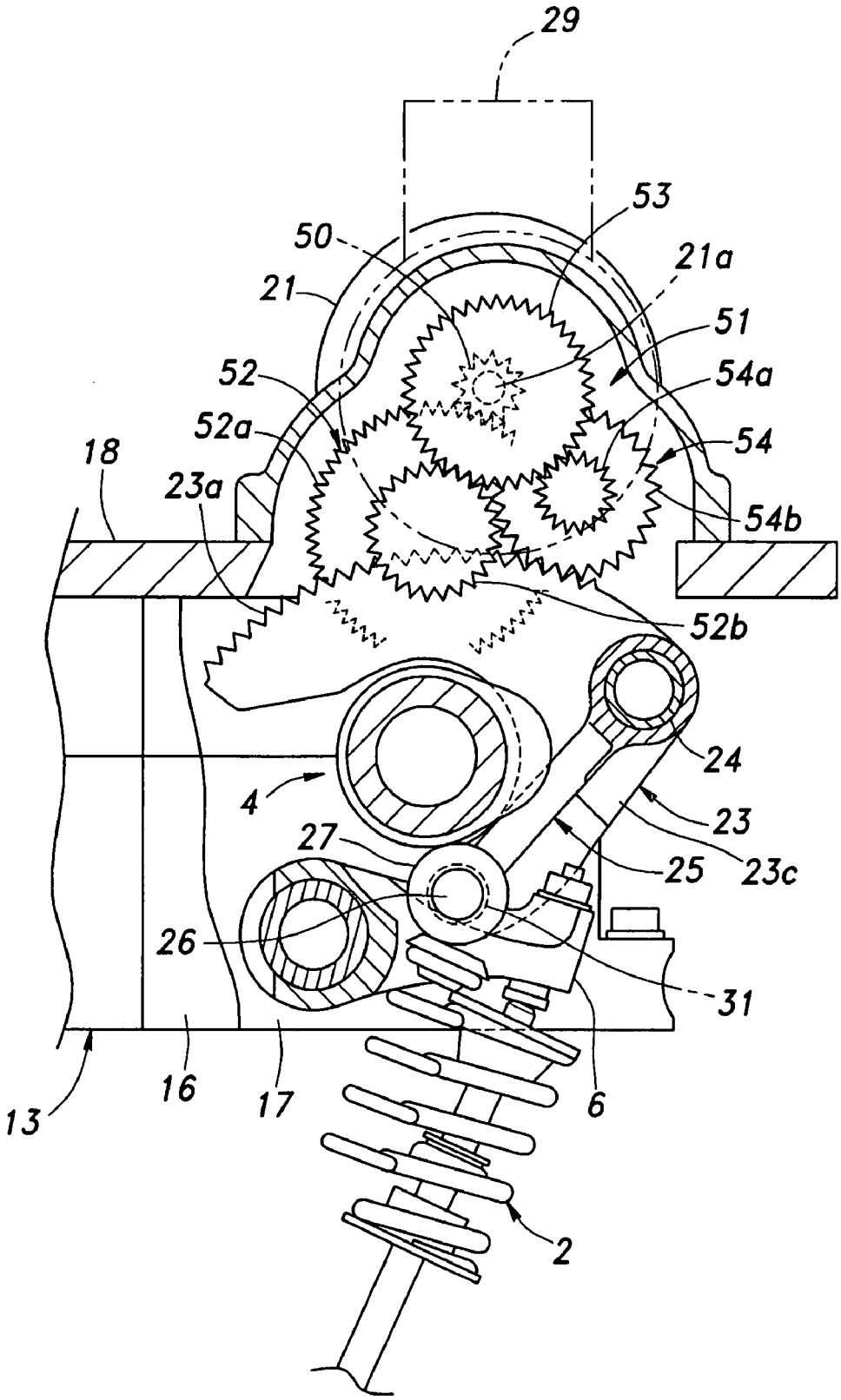
FIG. 12 is a fragmentary side view of the variable valve lift mechanism of the second embodiment.

FIG. 11 is a fragmentary perspective view of an upper part of the engine of the modified embodiment of the present invention showing through the head cover, and FIG. 12 is a fragmentary sectional view of the VLC mechanism used in this engine. In these drawings, the parts corresponding to those of the previous embodiment are denoted with like numerals without repeating the description of such parts. This embodiment differs from the previous embodiment in the way the output torque of the electric motor 21 is transmitted to the gear link 23. More specifically, a small-diameter, circular drive gear 50 and an intermediate gear train (intermediate gears) 51 are used, instead of the sector drive gear 22 used in the previous embodiment.

As shown in FIG. 12, the drive gear 55 consists of a spur gear having a relatively small diameter and a relatively small number of teeth. The intermediate gear train 51 includes three gears (first to third intermediate gears 52 to 54). The first intermediate gear 52 consists of a large gear portion 52*a* meshing with the drive gear 50 and a small gear portion 52*b* meshing with the second intermediate gear 53, the large gear portion 52*a* and the small gear portion 52*b* being integrally and coaxially joined to each other. The second intermediate gear 53 is an idler gear interposed between the first intermediate gear 52 and the third intermediate gear 54, and is connected to a sensor 29 (rotary encoder). The third intermediate gear 54 consists of a small gear portion 54*a* meshing with the second intermediate gear 53 and a large gear portion 54*b* meshing with the driven gear portion 23*a* of the gear link 23, the mall gear portion 54*a* and the large gear portion 54*b* being integrally and coaxially joined to each other.

In the modified embodiment, owing to the structure described above, the diameter of the drive gear 50 can be reduced, and this contributes to a compact design of the engine E. Also, because the rotation of the electric motor 21 is transmitted to the gear link at a substantially reduced speed ratio, the torque requirement of the electric motor 21 is minimized, and the electric motor may consist of a relatively compact one. Because the electric motor 21 and the sensor 29 may be placed in relatively low positions, and this, combined with the low profiles of the electric motor and sensor, can reduce the overall height of the engine. Therefore, the space requirement of the engine may be minimized. Because the gravitational center of the engine E can be lowered owing to the low profile design of the electric motor and the associated speed reduction gear mechanism, the driving performance of the vehicle may be improved.

Although the present invention has been described in terms of preferred embodiments thereof, it is obvious to a person skilled in the art that various alterations and modifications are possible without departing from the scope of the present invention which is set forth in the appended claims. For instance, the illustrated embodiments were directed to the in-line four-cylinder DOHC gasoline engine having a variable valve lift mechanism provided only to the exhaust valve actuating mechanism, but the present invention is also applicable to different types engines such as V-cylinder engines, SOHC engines and diesel engines, and to those having a variable valve lift mechanism provided only to or additionally to the intake valve actuating mechanism. The speed reduction gear used in the foregoing embodiments essentially consisted of spur gear mechanism, but worm speed reduction mechanisms, chain mechanisms, belt mechanisms and cam mechanisms may also be used. Also, the various details of the variable valve lift mechanism can be modified without departing from the spirit of the present invention.

The contents of the original Japanese patent applications on which the Paris Convention priority claim is made for the present application as well as those of the prior art references mentioned in this application are incorporated in this application by reference.

The invention claimed is:

1. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft, wherein the base end of the pivot arm is pivotally supported by a cam holder, and wherein the base end of the pivot arm is further pivotally supported by a pivot pin which is passed partly into a journal bore of the cam holder, the cam holder including an oil hole for supplying lubricating oil to the journal bore;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm.

2. The variable valve lift internal combustion engine according to claim 1, wherein the pivot arm and the power transmitting member are formed by an integral link member including a pivot arm portion pivotally supported by the cylinder head, a support portion pivotally supporting the control shaft and a power transmitting portion extending from the support portion and engaging an output end of the actuator.

3. The variable valve lift internal combustion engine according to claim 2, wherein the power transmitting portion of the integral link member comprises a driven gear portion that meshes with a drive gear of the actuator.

4. The variable valve lift internal combustion engine according to claim 3, wherein the drive gear comprises a sector gear.

5. The variable valve lift internal combustion engine according to claim 1, wherein the cam holder includes a pair of bifurcated support walls, and the pivot pin is passed across the support walls, the base end of the pivot arm being formed with a journal bore through which an intermediate part of the pivot pin passes.

6. The variable valve lift internal combustion engine according to claim 5, wherein the pivot pin is formed with an axial oil groove for conducting lubricating oil to the journal bore formed in the base end of the pivot arm.

7. The variable valve lift internal combustion engine according to claim 1, wherein the two axial surfaces of the pivot pin are engaged by corresponding thrust flanges formed in the camshaft.

8. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm;

an intermediate gear which is interposed between the drive gear and the driven gear portion; and wherein the pivot arm and the power transmitting member are formed by an integral link member including a pivot arm portion pivotally supported by the cylinder head, a support portion pivotally supporting the control shaft and a power transmitting portion extending from the support portion and engaging an output end of the actuator, wherein the power transmitting portion of the integral link member comprises a driven gear portion that meshes with a drive gear of the actuator.

9. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm; and wherein the pivot arm and the power transmitting member are formed by an integral link member including a pivot arm portion pivotally supported by the cylinder head, a support portion pivotally supporting the control shaft and a power transmitting portion extending from the support portion and engaging an output end of the actuator, wherein the power transmitting portion of the integral link member comprises a driven ear portion that meshes with a drive gear of the actuator, and an oil hole is provided in the cam holder for supplying lubricating oil to a part where the driven gear portion meshes with the drive gear.

10. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft, wherein the base end of the pivot arm is pivotally supported by a cam holder, and wherein the cam holder is provided with stopper portions for restricting a range of an angular movement of the control shaft;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm.

11. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft, wherein the base end of the pivot arm is pivotally supported by a cam holder, and wherein the cam holder supporting the base end of the pivot arm is located centrally along a length of the control shaft;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm.

12. A variable valve lift internal combustion engine, comprising:

an engine valve;

a camshaft mounted on a cylinder head of the engine and including a cam lobe;

a rocker arm pivotally supported by the cylinder head and including a first part that engages a valve stem of the engine valve;

a control shaft pivotally supported by the cylinder head via a pivot arm pivotally supported by the cylinder head so as to able to move angularly around a rotational center line extending in parallel with an axial line of the control shaft, wherein the base end of the pivot arm is pivotally supported by a cam holder, and wherein the engine includes a plurality of cam holders arranged along the rotational center line, and a base plate connects upper ends of the cam holder with one another;

a power transmitting member supported by the control shaft;

an actuator for causing an angular movement of the control shaft around the rotational center line via the power transmitting member; and a control arm having a base end pivotally supported by the control shaft and a free end interposed between the cam lobe and a second part of the rocker arm;

a lift of the engine valve being varied by angularly moving the control shaft around the rotational center line and moving the base end of the control arm.

13. The variable valve lift internal combustion engine according to claim 12, further comprising a head cover that covers a valve actuating mechanism provided on a cylinder head of the engine jointly with the base plate, the head cover including an edge that abuts a surface of the base plate via a seal member.

14. The variable valve lift internal combustion engine according to claim 13, wherein the head cover is provided with an annular configuration including a central window, and a peripheral edge of the head cover surrounding the central window abuts a surface of the base plate via a seal member.

* * * * *